United States Patent [19]

Reed et al.

[11] Patent Number: 4,534,300

[45] Date of Patent: Aug. 13, 1985

[54] COMBUSTION CHAMBER FOR COMBUSTION DISPOSAL OF WASTE MINERAL BEARING STREAMS

[75] Inventors: Robert D. Reed; John M. Cegielski, Jr., both of Tulsa, Okla.

[73] Assignee: John Zink Company, Tulsa, Okla.

[21] Appl. No.: 205,713

[22] Filed: Nov. 10, 1980

[51] Int. Cl.[3] ..... F23J 1/06

[52] U.S. Cl. ..... 110/171; 110/208

[58] Field of Search ..... 110/171, 128, 138, 208

[56] References Cited

U.S. PATENT DOCUMENTS

| | | | |
|---|---|---|---|
| 1,348,737 | 8/1920 | Ralston | 110/171 |
| 1,819,486 | 8/1931 | Scherman | 110/171 |
| 2,031,578 | 2/1936 | Wilgus | 110/171 |
| 2,339,216 | 1/1944 | Alladrice | 110/171 |
| 4,050,387 | 9/1977 | Luchsinger et al. | 110/208 |

*Primary Examiner*—Henry C. Yuen

*Attorney, Agent, or Firm*—Head, Johnson & Stevenson

[57] ABSTRACT

In the combustion of waste mineral-bearing liquid streams, an improved type of construction for the combustion chamber, for the combustion of waste mineral-bearing liquid streams which permits continuous removal of solid particulate waste. An annular water channel is fitted inside of the outer shell of the combustion chamber at the bottom. The bottom of the chamber is closed off with a funnel-shaped, inverted conical floor, having a drain outlet at its center. An opening is provided in the side of the combustion chamber just above the bottom, for the exit of downflowing products of combustion. Water is supplied to the annular channel and flows through a longitudinal gap in the inner wall, to fall onto the funnel-shaped floor plate, to wash down all of the particulate matter that collects on the bottom plate, into the drain. Thus, the waste is removed as it is formed. The refractory lining of the chamber is shaped with an inwardly-directed flange to permit the flow of molten material down the refractory surface onto the funnel-shaped floor plate and to protect the water channel from direct heating by the flame in the cumbustion chamber.

4 Claims, 8 Drawing Figures

COMBUSTION CHAMBER FOR COMBUSTION DISPOSAL OF WASTE MINERAL BEARING STREAMS

BACKGROUND OF THE INVENTION

1. Field of the Invention

This invention lies in the field of waste disposal. More particularly, it concerns the disposal of liquid streams that have metal salts in solution, as well as particulate waste.

2. Description of the Prior Art

Combustion gas flow stoppage, or incremental obstruction of the flow paths for the gas, has, in the past, very seriously interfered with disposal of liquids which are mineral-bearing and also are industrial wastes. The best and most accepted method of disposal has been by introducing the liquids to a combustion zone in the form of a fine (micron size) spray where the heat-induced reactions typical of a combustion zone cause the radical of the mineral salt to first oxidize and then, due to the presence of $CO_2$, to form the carbonate of the mineral (metal) radical, at or near to exit from the combustion zone. The carbonate (or bicarbonate) persists in the gases resulting from combustion as either molten solid, or as a particulate solid, according to the retrograde temperature level. If the solid is molten and strikes the side of the combustion chamber, it clings, to run down the sides of the combustion chamber to accumulate on the floor of the combustion chamber. The unmolten solid matter (carbonate or bicarbonate) also adds to the solid accumulation via 'drop-out' or other effect, in such a manner that in varying times, which can be as little as 36 hours, the gas passage becomes essentially closed and disposal must cease.

This condition is intolerable because the blockage thus described occurs at or on the bottom of the combustion chamber, as the pile rises, in added deposit, to block the gas exit from the combustion chamber. The gas exit is, perforce, at the end or bottom of the combustion chamber and for at least horizontal exit, or exit above the horizontal which is at least at 90 degrees to the vertical axis of the combustion chamber. The salt obstruction problem has, through long experience, been a serious deterrent to combustion-disposal of mineral-laden liquids.

The liquid streams vary widely and may not possess sufficient calorific value for self-burning. Burners for admission of the micronized (atomized) liquids to the combustion chamber are equipped with means for admission of standard fuels along with the liquid streams, to assure burning (combustion) as a standard condition. All systems provide for uninterrupted burning for calculated periods, which are followed by calculated entry of cooling fluids for combustion temperature decrease, in a calculated manner and to a calculated degree. However, due to inherent difficulty in providing adequate rapid cooling, most of the mineral matter remains in the molten state, and as it 'wets' any hot surface it strikes to run down the combustion chamber walls to the floor (or bottom) of the combustion chamber and accumulate as recited. Also, gas-borne molten particles are driven by the gases into direct contact with the floor or bottom of the combustion chamber.

SUMMARY OF THE INVENTION

It is a primary object of this invention to provide an improved construction for the combustion chamber of apparatus designed to dispose of liquid waste streams, which carry particulate waste and/or chemical products of minerals or metals.

These and other objects are realized and the limitations of the prior art are overcome in this invention by providing a specially-designed construction for the lower portion of the lower chamber of a conventional apparatus for the disposing of liquid waste.

Such devices are generally constructed with two cylindrical chambers positioned coaxially one above the other, with a burner at the top, with the fuel and air streams directed downwardly. At some intermediate point the waste liquid is micronized (atomized) into extremely small droplets, so as to be converted rapidly, in the high temperature atmosphere of the combustion chamber into vapor and chemical salts of the minerals.

Since the streams of flame and products of combustion are directed downwardly, most of this mineral material is directed to the bottom of the lower chamber. However, if turbulent combustion is provided, there is contact with the refractory wall of the chamber and the molten salts can flow down the inner wall of the refractory onto the bottom of the chamber.

The floor of the chamber is positioned just below the outlet through the wall of the chamber, for the exit of the products of combustion. Thus, the particulate matter collects on the floor and must be removed, in a continuous fashion, to avoid building up a deposit of such size as to close, or partially close, the passage for the hot products of combustion, which would necessitate the stoppage of the combustion process, and removal of the solid material.

The improvements of this invention lie in the construction of the bottom of the combustion chamber, which is in the shape of a flat funnel, of inverted conical shape, with a drain pipe at the center at the lowest part of the floor. A circular annular water channel is provided along the inside surface of the wall of the chamber, just above the floor. The circular channel can be of round or rectangular cross-section, but has a slot or opening at the top of the inner wall. Water is supplied to and flows circumferentially in the channel, out through a circumferential gap or opening, near the top of the inner wall. The water flows down to the floor, and diagonally downwardly toward a center drain at the bottom of the funnel. The water flows in a continuous film covering the floor and can chemically dissolve or mechanically wash away the particles which have been deposited on the top of the conical floor.

Because of the necessary cross-sectional size of this water channel, the bottom end of the refractory lining of the chamber is extended inwardly in the form of a flange, so that the inner diameter of the refractory is smaller than the diameter of the inner wall of the channel. Thus, molten material flowing down the refractory wall will flow over the inner edge of the refractory, directly onto the metal floor, and will be washed down by the water flowing over the inner wall of the channel.

BRIEF DESCRIPTION OF THE DRAWINGS

These and other objects and advantages of the invention and a better understanding of the principles and details of the invention will be evident from the following description taken in conjunction with the appended drawings in which.

DETAILED DESCRIPTION OF THE PREFERRED EMBODIMENTS

Figure 7:
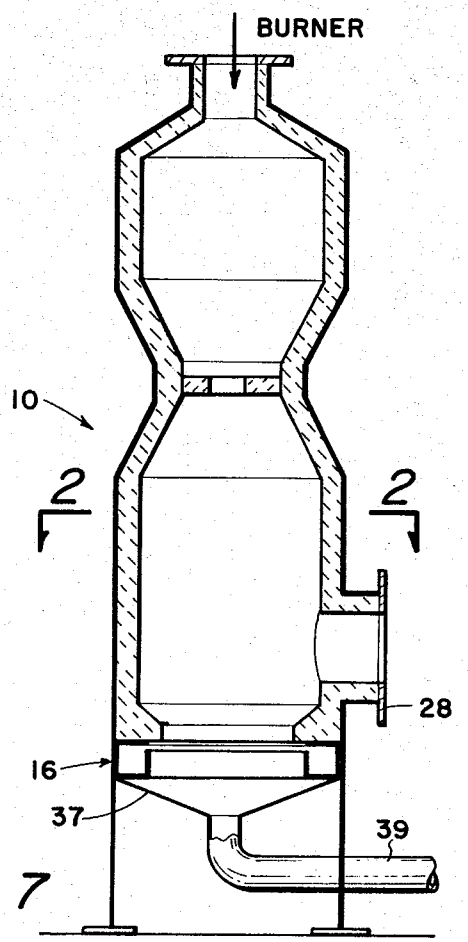
FIG. 7 is a generalized sketch of the overall construction of the waste disposal unit of which this invention forms only a part.

Referring now to the drawings and, in particular, to FIG. 7, there is illustrated schematically, the general construction of a conventional combustion system, for combustion disposal of liquid waste streams. Such overall construction forms no part of this invention and will not be described, other than the lower portion 10, below the plane 2—2 of the lower chamber, which is the part which involves this invention.

Figure 2:
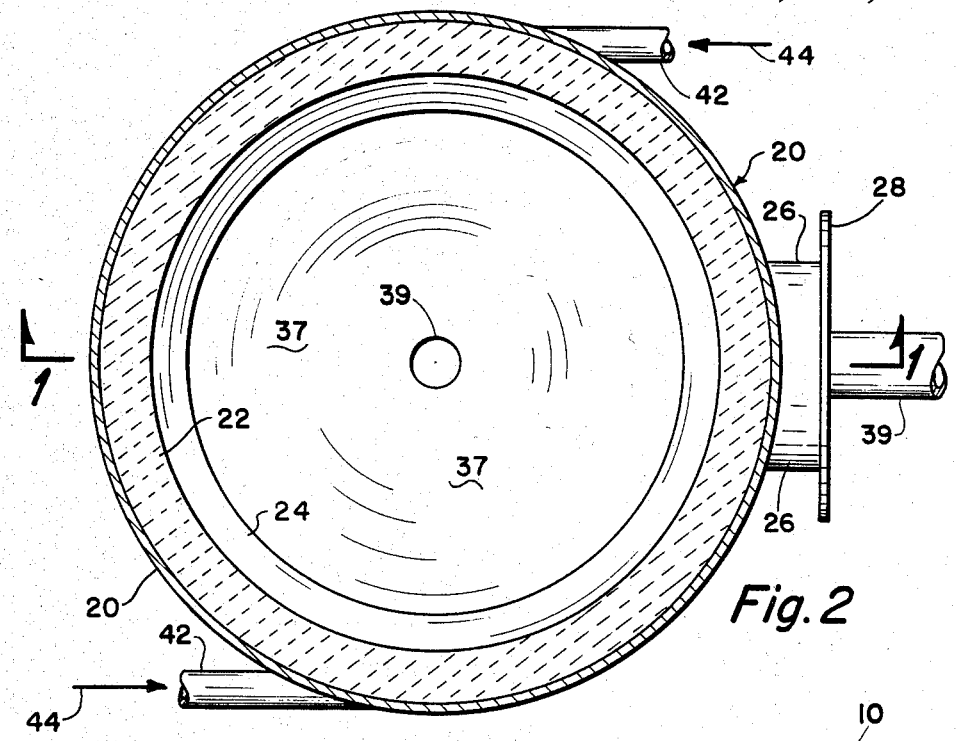
FIG. 2 is a horizontal cross-section taken across the plane 2—2 of FIG. 1.
Figure 1:
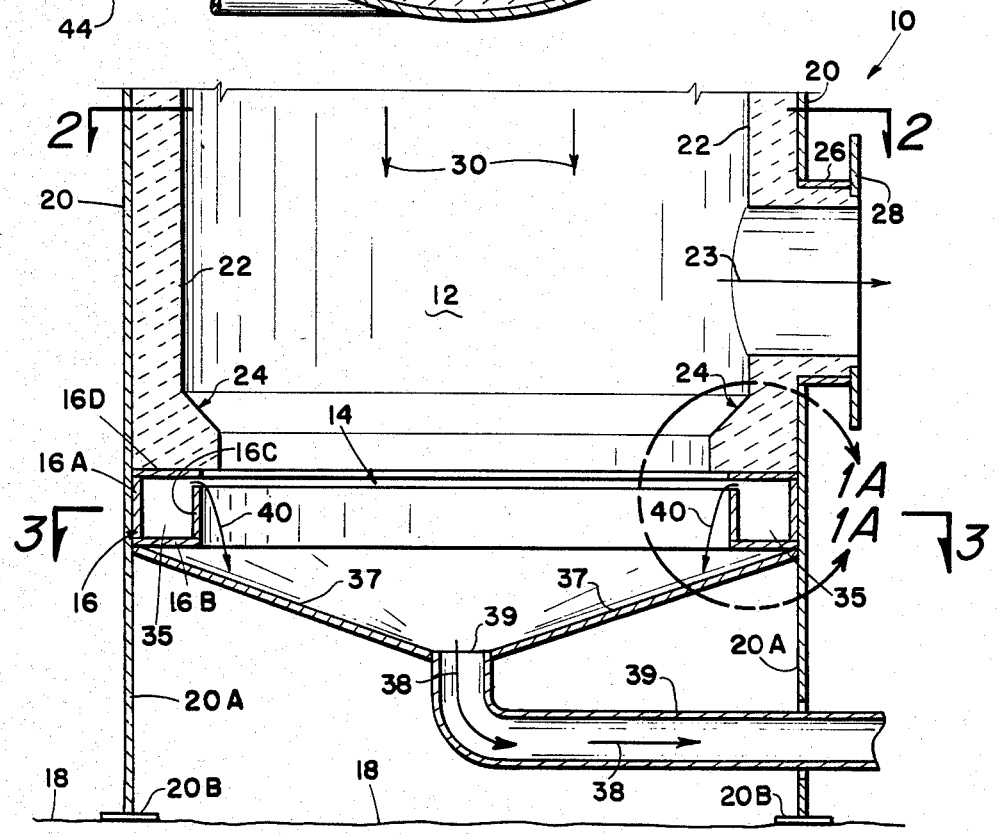
FIG. 1 illustrates a vertical diametral cross-section of the lower portion of the lower chamber taken across the plane 1—1 of FIG. 2.

Referring now to FIGS. 1 and 2, there is shown to a large scale the lower half of the lower chamber indicated generally by the numeral 10.

The lower combustion chamber comprises a cylindrical steel chamber 20 having an outlet pipe 26 and flange 28 for attachment of conduit for exit of products of combustion, indicated by arrow 23. Numeral 22 indicates a refractory lining on the inner wall 20 of the chamber, for the protection of the steel from the hot flame, indicated by the arrows 30 moving downwardly from the upper chamber into the lower chamber to exit as indicated by arrow 23.

In the upper chamber (not shown, but well-known in the art) the waste liquid stream is atomized, or micronized, into very minute droplets, which as they enter the hot flame of the burner are evaporated to leave solid particles, or molten material, which are carried down with the flame and product of combustion indicated by arrows 30, to collect on the bottom plate 37 of the chamber. The inner volume of the chamber is indicated generally by the numeral 12.

The bottom, or floor plate 37 of the chamber 20, is formed in an inverted conical shape, or flat funnel shape, to provide a sloping wall leading down to a center outlet 39. A drain pipe 39 is attached to the floor drain to carry away the water stream 38, carrying the solid particulate waste.

Numeral 16 indicates generally a circular annular channel closed by outer plate 16A, bottom plate 16B, inner plate 16C and top plate 16D. The channel is closed except for a circumferential slot or gap 14, which is of selected width, or vertical extent. While we have illustrated the annular channel as having a rectangular cross-section, it will be clear that the channel can also be of circular or other cross-section.

Figure 1A:
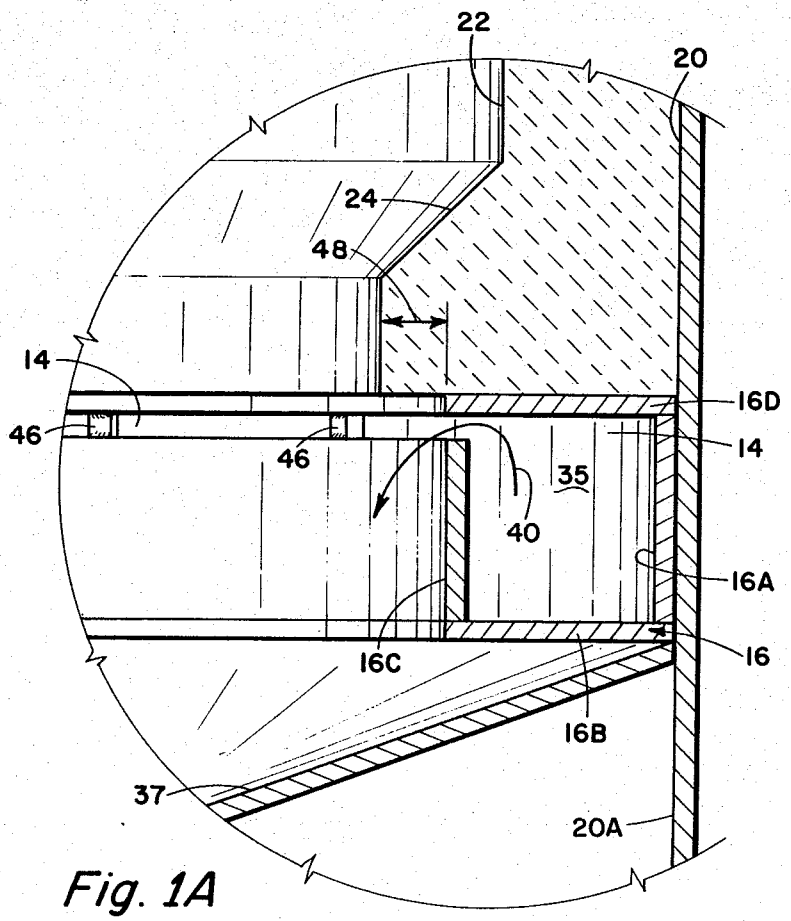
FIG. 1A is an enlarged view of portion 1A—1A of FIG. 1.

Further details of FIG. 1, and particularly the area circled by the line 1A—1A are illustrated to greater scale by FIG. 1A. Here the arrangement of the cylindrical wall 20 and the support extension 20A, are shown, and the relationship of the funnel shaped floor plate 37 welded to the wall plate 20, and the positioning of the water channel 16 on top of the floor, with the refractory 22 positioned above the water channel 16, having an inwardly projecting flange or foot 24, which extends inwardly of the inner wall 16C of the water channel by a selected dimension 48. Thus, any molten chemical salt deposited on the wall of the refractory 22 will flow down that wall onto the sloping portion of the flange 24 and will drop directly down onto the floor plate 37 of the chamber, to be washed away.

Figure 3:
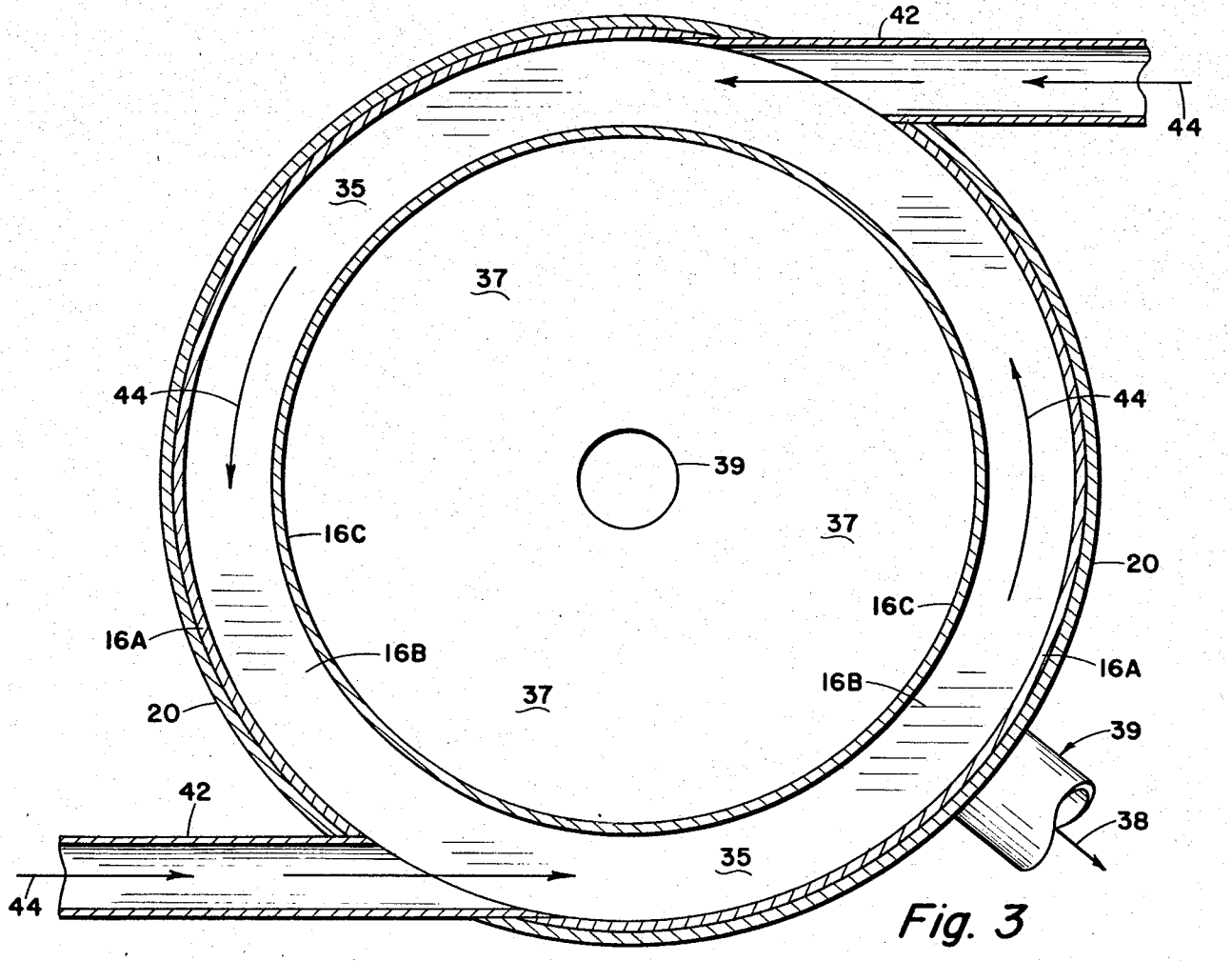
FIG. 3 is a horizontal cross-section taken through the water channel at the transverse plane 3—3 of FIG. 1.

Referring now to FIG. 3, there is shown in cross-section a view of FIG. 1 taken across the horizontal plane 3—3. Here are shown in cross-section the outer wall 20 of the chamber, the outer wall 16A of the water channel, the inner wall 16C of the inner channel and the bottom plate 16B of the water channel, and the tangent entry pipes 42, through which water flows inwardly in accordance with the arrows 44. The space inside of the channel is indicated by the numeral 35. There is a circularly flowing water stream to supply the water level to the inner wall, or weir, which flows down over the inside wall 16C onto the floor 37, and flows downwardly along the floor, toward the outlet pipe 39, which exits radially from the chamber structure. The water flow through exit pipe 39 is shown by arrow 38.

Figure 4:
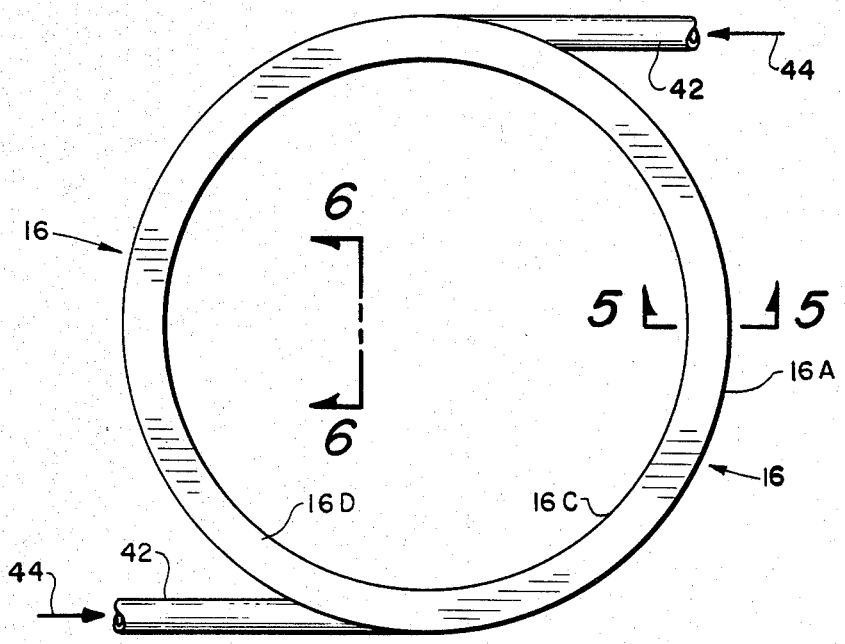
FIGS. 4, 5 and 6 represent, respectively, a plan view of the water channel structure, a cross-section taken across a radial plane through the water channel, and a view of the inner surface of the water channel.
Figure 5:
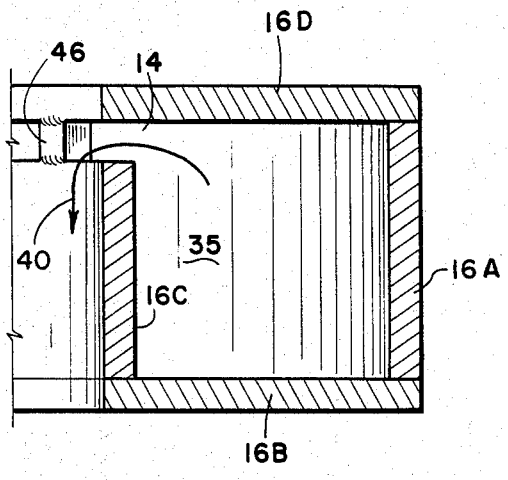
Figure 6:
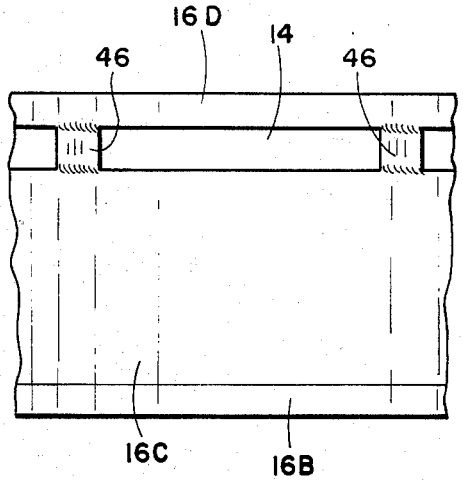

Referring now to FIGS. 4, 5, and 6, FIG. 4 illustrates a plan view of the ring channel 16, which, in addition to having the rectangular cross-section of FIG. 5, has at least one pipe, or preferably two pipes, 42 welded tangentially into the ring, for the entry of water from a conventional source, (not shown) flowing inwardly in accordance with arrow 44. As previously mentioned, the inner wall 16C is vertically shorter than the outer wall 16A, so as to provide circumferential opening or gap 14, which is supported by welded spacers 46 at selected spacing around the inner wall of the ring. The use of the spacers 46 to provide a selected dimension of the overflow gap is important, since, in the hot regions of a structure, such as this combustion chamber, heat warpage can cause sizable changes in the dimension of gaps such as 14. Since a uniformly thick layer or film of water is desired, the uniform width of the gap is very important.

It is important that there be sufficient and uniform outflow of liquid from the internal space 35, over the inner wall 16C and through the gap 14 as shown in FIG. 1. When this water flows onto the bottom plate 37 it covers the floor with a uniform film, and will chemically dissolve or mechanically remove any particulate matter collecting on the floor 37. Since the inner wall is completely circular there will be a uniform evenly-divided flow of water onto the plate from the outer portion of the floor under the ring 16, down to the center drain with the outlet pipe 39. The effluent of water and particulate matter is illustrated by the arrows 38 which flow to a further treatment or separation point. The chamber wall 20 extends downwardly 20A and rests on the grade 18 by means of foot plates 20B, etc., as is conventional.

FIG. 5 is a cross-section taken across the radial plane 5—5 of FIG. 4.

FIG. 6 is an internal view of the ring taken across the plane 6—6 of FIG. 4.

What has been described is an improved construction of the lower portion of a combustion chamber of a waste disposal unit, of otherwise conventional design. The improved construction of the lower end of the lower chamber facilitates the continuous removal of the particulate matter which remains after the waste stream has been burned and/or evaporated, and disposes of it continuously, to avoid any possible accumulation that would affect the flow of the products of combustion that flow downwardly through the structure, and out of the lower exit portal.

While the invention has been described with a certain degree of particularity, it is manifest that many changes may be made in the details of construction and in the arrangement of components. It is understood that the invention is not to be limited to the specific embodiments set forth herein by way of exemplifying the invention, but the invention is to be limited only by the scope of the attached claims, including the full range of equivalency to which each element or step thereof is entitled.

What is claimed is:

1. In a combustion chamber for the combustion disposal of waste mineral-bearing liquid streams, in which a vertically-disposed cylindrical refractory-lined combustion chamber is provided with down-flow of fuel, air, flame, micronized waste liquid and products of combustion, the improvements in means for removing the products of combustion and for collecting and removing solid waste and solidified mineral compounds, comprising:

(a) an exit opening adjacent the bottom of the combustion chamber for said removal of said products of combustion;

(b) an inverted conical, or funnel-shaped floor plate positioned below the combustion chamber, with drain means for disposal of said solid waste and compounds;

(c) a circular, annular or peripheral channel between the top of the floor plate and the bottom of the combustion chamber, means to flow water tangentially into said channel, and a circumferential gap between the bottom of said combustion chamber and an inner wall of said channel, so that said water flows in a circular motion through said gap and onto the sloping floor plate, carrying solidified and particulate waste down said drain means.

2. The apparatus in claim 1 wherein said refractory lining of said chamber extends down to near the top of said annular channel, and, the bottom of said combustion chamber is of refractory material formed with an inwardly extending flange of lesser inner diameter than the diameter of the inner wall of said channel.

3. The apparatus as in claim 2 in which said circumferential gap is held at constant width by a plurality of spacers positioned circumferentially around the inner wall.

4. The apparatus as in claim 2 in which the top surface of said inwardly extending flange slopes inwardly and downwardly; whereby molten material collecting on said refractory-lined combustion chamber can flow down to said flange, down said sloping top surface, to drop onto said floor plate.

* * * * *